US007575782B2

(12) United States Patent
Suganuma et al.

(10) Patent No.: US 7,575,782 B2
(45) Date of Patent: Aug. 18, 2009

(54) METHOD FOR DEPOSITING OIL AGENT ON WORKPIECE

(75) Inventors: Nobuyuki Suganuma, Nagoya (JP); Mitsuyoshi Shiba, Toukai (JP); Yoshiaki Matsubara, Nagoya (JP); Makoto Hirasawa, Kasugai (JP)

(73) Assignee: NGK Spark Plug Co., Ltd., Aichi (JP)

( * ) Notice: Subject to any disclaimer, the term of this patent is extended or adjusted under 35 U.S.C. 154(b) by 471 days.

(21) Appl. No.: 10/554,954

(22) PCT Filed: Dec. 22, 2004

(86) PCT No.: PCT/JP2004/019205

§ 371 (c)(1),
(2), (4) Date: Oct. 28, 2005

(87) PCT Pub. No.: WO2005/065846

PCT Pub. Date: Jul. 21, 2005

(65) Prior Publication Data

US 2006/0233962 A1 Oct. 19, 2006

(30) Foreign Application Priority Data

Jan. 8, 2004 (JP) ..... 2004-003409

(51) Int. Cl.
*B05D 3/00* (2006.01)
*B05D 3/02* (2006.01)
*B05D 1/18* (2006.01)

(52) U.S. Cl. ..... 427/299; 427/327; 427/372.2; 427/430.1; 427/443

(58) Field of Classification Search ..... 427/327, 427/430.1, 299, 372.2, 226; 134/40; 313/118; 445/7

See application file for complete search history.

(56) References Cited

U.S. PATENT DOCUMENTS

| | | | | | |
|---|---|---|---|---|---|
| 3,899,625 | A | * | 8/1975 | Izumi et al. | 428/457 |
| 4,236,940 | A | * | 12/1980 | Manty et al. | 428/472.1 |
| RE32,168 | E | * | 6/1986 | Yoshinari | 123/647 |
| 5,064,500 | A | * | 11/1991 | Awad | 216/103 |

FOREIGN PATENT DOCUMENTS

| | | | | |
|---|---|---|---|---|
| CN | 1392284 | A | | 1/2003 |
| DE | 4202607 | A1 | | 5/1993 |
| GB | 2241963 | A | * | 9/1991 |
| JP | 9-170089 | A | | 6/1997 |
| JP | 2000-265281 | A | | 9/2000 |
| JP | 2001-234357 | A | | 8/2001 |
| JP | 2002-12982 | A | | 1/2002 |
| JP | 2002-12983 | A | | 1/2002 |
| JP | 2003-160879 | A | | 6/2003 |

OTHER PUBLICATIONS

"Use of Water-Soluble Antirust in Preventing Rust in a Process"; Published Dec. 31, 1982; pp. 45-51 (Chinese language).

* cited by examiner

*Primary Examiner*—Michael Cleveland
*Assistant Examiner*—Michael Wieczorek
(74) *Attorney, Agent, or Firm*—Sughrue Mion, PLLC

(57) ABSTRACT

An oil agent of the kind and amount suitable for a post-step is applied on a workpiece regardless of the kind and residual amount of an oil agent used in a pre-step. A workpiece on which a first oil agent is deposited is immersed in a degreasing solution, taken out of the degreasing solution and cleaned to thereby remove all the first oil agent. Then, the workpiece having all the first oil agent removed is immersed in an oil agent solution to thereby newly deposit a second oil agent of the kind and amount suitable for a post-step on the workpiece.

5 Claims, 3 Drawing Sheets

METHOD FOR DEPOSITING OIL AGENT ON WORKPIECE

TECHNICAL FIELD

The present invention relates to a technique for depositing an oil agent on a workpiece of a metal material, a synthetic resin material, etc.

BACKGROUND ART

When a material is processed by a plurality of steps successively as in the case of production of parts of a machine, an oil agent such as a lubricating oil agent, a cutting oil agent or a grinding oil agent used for lubrication or cooling at the time of mechanical processing such as plasticizing, cutting or grinding is deposited and remains on a workpiece obtained by mechanically processing a metal material in a pre-step. The amount and kind of the remaining oil agent may be unsuitable for a mechanical processing step or an assembling step after that.

Moreover, an oil agent such as a lubricant or a releasant used for lubrication or mold-releasing at the time of plasticizing such as stretching, molding or compressing is deposited and remains on a workpiece obtained by plasticizing a synthetic resin material in a pre-step. The amount and kind of the remaining oil agent may be unsuitable for a plasticizing step or an assembling step after that.

When the amount of the oil agent remaining on a workpiece of a metal material, a synthetic resin material, etc. is too large or too small for the step after that, the amount of the deposited oil agent is needed to be increased/decreased to a suitable amount for the post-step in such a manner that a part of the remaining oil agent is washed off or the same oil agent is added to the remaining oil agent. High-grade skill and much experience are required for adjusting the amount of the deposited oil agent to a desired amount suitable for the post-step in the work of increasing/decreasing the amount of the deposited oil agent.

DISCLOSURE OF THE INVENTION

Problem that the Invention is to Solve

In the aforementioned workpiece of a metal material, a synthetic resin material, etc. as processed in a pre-step, the amount of the remaining oil agent however varies widely. Accordingly, much labor is required for the aforementioned method of washing off a part of the remaining oil agent or adding a new oil agent to the remaining oil agent to increase/decrease the amount of the deposited oil agent suitable for a post-step.

The present invention is accomplished in consideration of the problem and an object of the present invention is to provide a method of depositing an oil agent on a workpiece, in which the amount of the deposited oil agent can be adjusted easily and accurately when the oil agent (specific oil agent) of the amount and kind suitable for the post-step is deposited on the workpiece.

Means for Solving the Problem

A measure to solve the problem is a method of depositing an oil agent on a workpiece, comprising the steps of: immersing a workpiece having a remaining oil agent in a degreasing solution, taking the workpiece out of the degreasing solution and cleaning the workpiece to thereby remove all the oil agent deposited on the workpiece (removal step); and immersing the workpiece having all the oil agent removed in an oil agent solution to thereby deposit a predetermined amount of a specific oil agent (oil agent deposition step).

To adjust the amount of the oil agent deposited on the workpiece, there has been heretofore discussed a method of removing a part of the oil agent deposited on the workpiece or adding a new oil agent to the oil agent deposited on the workpiece. On the contrary, in the oil agent deposition method according to the present invention, there is used a method of depositing a new oil agent (specific oil agent) after removing all the oil agent (remaining oil agent) deposited on the workpiece.

In this manner, when a predetermined amount of the specific oil agent is deposited on the workpiece on which no remaining oil agent is deposited, the amount of the oil agent deposited can be adjusted easily and accurately. Accordingly, with respect to the workpiece on which the oil agent deposited in a pre-step or the like remains, the oil agent is removed and a new oil agent (specific oil agent) is deposited on the workpiece even in the case where the amount of the oil agent deposited on the workpiece varies widely. Much labor is not required for adjusting the amount of the deposited oil agent to an amount suitable for a post-step. Even in the case where the kind of the oil agent remaining on the workpiece is not suitable for the post-step but another kind of oil agent needs to be deposited in the post-step, a predetermined amount of oil agent of the kind suitable for the post-step can be deposited on the workpiece in accordance with the present invention because a method of removing all the remaining oil agent and depositing a specific oil agent is used in the present invention.

Incidentally, a component, a product or an in-process product thereof can be taken as an example of the workpiece. The material of the workpiece may be metal, synthetic resin, or ceramic. Examples of the metal include steel such as carbon steel, stainless steel or alloy steel, or nonferrous metal such as copper alloy or aluminum alloy. For example, general-purpose plastics or engineering plastics may be used as the synthetic resin.

A metal component to be attached to an internal combustion engine can be taken as an example of the component made of metal. More specifically, a metal shell 101 which is used for forming a gas sensor 100 shown in FIG. 4 and which is to be attached to an exhaust pipe of an internal combustion engine or a metal shell 111 which is used for forming a spark plug 110 shown in FIG. 5 and which is to be attached to an engine block of an internal combustion engine can be taken as an example. Incidentally, a caulking portion 103 or 113 is formed in the metal shell 101 or 111. To form the caulking portion 103 or 113 smoothly by use of a caulking jig, an oil agent needs to be provided at least on a surface of the metal shell 101 or 111 where the caulking portion 103 or 113 will be formed. In this case, the oil agent deposition method according to the present invention is preferably used for depositing a predetermined amount of the oil agent.

The degreasing solution can be selected suitably in accordance with the workpiece and the oil agent deposited on the workpiece in the same manner as in the degreasing process in the background art.

Incidentally, a step of drying the workpiece is generally required between the oil agent removal step for washing off the remaining oil agent deposited on the workpiece and the step of depositing a new specific oil agent. Accordingly, the labor for drying the workpiece in an intermediate step is required more or less.

Therefore, according to the present invention, there is preferably provided the method of depositing an oil agent on a workpiece, wherein: in the removal step, the cleaning is performed by water washing; and in the oil agent deposition step, the workpiece wet with water after the water washing is immersed in an oil agent solution containing a water-soluble oil agent dissolved in water, taken out of the oil agent solution and dried to thereby deposit a predetermined amount of the water-soluble oil agent as the specific oil agent on the workpiece.

To remove all the oil agent remaining on the workpiece, the workpiece having the oil agent deposited thereon is immersed in the degreasing solution so that the oil agent is released. When the workpiece is taken out of the degreasing solution, the oil agent-containing degreasing solution is deposited on the workpiece. Here, the workpiece taken out of the degreasing solution is cleaned by means of water washing. When the oil agent-containing degreasing solution is washed off with water, the workpiece degreased and washed with water is wet with water. On this occasion, a hydrophobic or water-repellant substance is hardly deposited but a hydrophilic substance is easily deposited on the workpiece wet with water.

That is, in the present invention, there is used a method of depositing a hydrophilic oil agent as a specific oil agent on the workpiece wet with water after degreasing and water washing by utilizing such property that a hydrophilic substance can be easily deposited on the workpiece wet with water. By this method, the oil agent (water-soluble oil agent as a specific oil agent) can be deposited on the workpiece degreased and washed with water without necessity of drying the workpiece. A predetermined amount of the oil agent can be deposited on the workpiece with less labor.

To deposit an oil agent (specific oil agent) on the workpiece, the workpiece is immersed in an oil agent solution containing a water-soluble oil agent dissolved in an aqueous solution and then the aqueous solution of the oil agent solution deposited on the surface of the workpiece is removed after the workpiece is taken out of the oil agent solution, so that the oil agent can be easily deposited on the surface of the workpiece evenly. Therefore, the present invention is configured so that the workpiece degreased and washed with water is immersed in an oil agent solution containing a water-soluble oil agent as a hydrophilic oil agent while the workpiece is wet with water, and then the workpiece is dried after taken out of the oil agent solution. That is, the water content of the oil agent solution deposited on the surface is removed.

Incidentally, ordinary-temperature water, warm water or hot water can be used for the water washing. An emulsion (emulsified oil) prepared by emulsifying mineral oil with an anionic surface active agent, a chemical solution containing inorganic salt as a main component, a soluble containing a surface active agent as a main component, or the like, can be used as the water-soluble oil agent.

In the case where dispersion of the water-soluble oil agent in the oil agent solution is insufficient, an activator may be added in order to disperse the water-soluble oil agent. The activator can be selected suitably in accordance with the kind of the water-soluble oil agent. Various kinds of activators may be used regardless of whether nonionic activators or ionic activators. Anionic activators, cationic activators or amphoteric activators may be used as the ionic activators.

Moreover, in the present invention, there is provided the method of depositing an oil agent on a workpiece, wherein the concentration of the oil agent solution is preferably adjusted so that the amount of the water-soluble oil agent deposited on the workpiece is set to be a predetermined amount suitable for a post-step or the kind of the water-soluble oil agent put into the oil agent solution is preferably selected so that the kind of the water-soluble oil agent deposited on the workpiece is set to be a kind suitable for a post-step. When the concentration and kind of the water-soluble oil agent put in the oil agent solution is adjusted in this manner, it is not necessary to adjust the oil agent again in the post-step so that the labor required for depositing the oil agent can be reduced more extremely.

DESCRIPTION OF THE REFERENCE NUMERALS

100 . . . gas sensor, 101, 111 . . . metal shell, 110 . . . spark plug, 103, 113 . . . caulking portion.

BEST MODE FOR CARRYING OUT THE INVENTION

FIRST EXAMPLE

Figure 1:
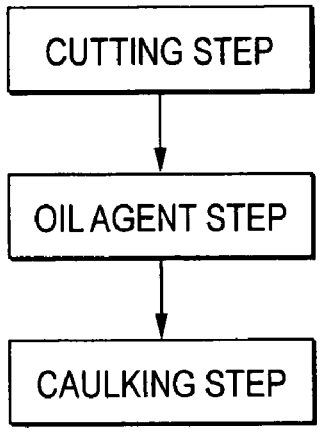
FIG. 1 A process view of a process, inclusive of a pre-step and a post-step, in an oil agent deposition method according to a first example of an embodiment of the present invention.
Figure 2:
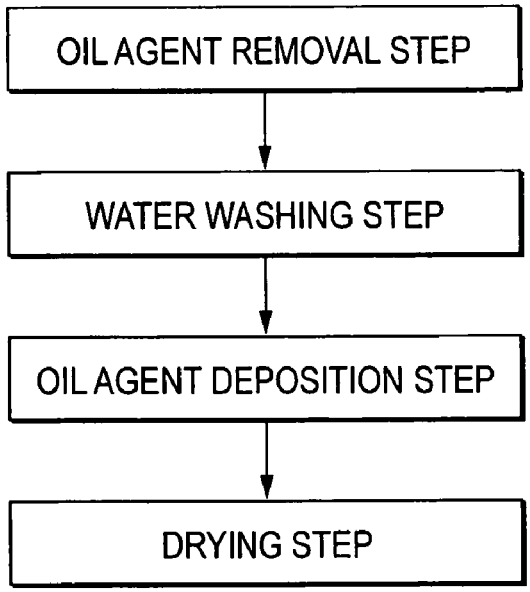
FIG. 2 A process view of the oil agent deposition method according to the embodiment.

See FIGS. 1 and 2

In this example, each workpiece is a metal component of a transport machine and made of stainless steel. As shown in FIG. 1, these components go through a "cutting step", an "oil agent step" and a "caulking step" successively. In the "oil agent step", a method of depositing an oil agent according to this example is carried out. The "caulking step" is a kind of plasticizing.

A cutting oil agent used for cooling, lubrication or chip removal is deposited and remains on the workpieces cut by the "cutting step". The amount of the remaining oil agent deposited varies widely and is not suitable for the "caulking step" which is the post-step. In the "caulking step", it is necessary to provide an adequate amount and kind of oil agent suitable for lubrication to reduce friction with a caulking tool and cooling of the friction portion.

Therefore, as shown in FIG. 2, the workpieces cut by the "cutting step" which is the pre-step go through an "oil agent removal step", a "water washing step", an "oil agent deposition step" and a "drying step" successively in place of the "oil agent step" before the "caulking step" to deposit an oil agent suitable for the "caulking step" which is the post-step.

A large number of workpieces cut thus are put in a wire mesh cage. The wire mesh cage in which the workpieces are put is moved in a degreasing solution in a processing tank while sunk into the degreasing solution in the "oil agent removal step". The respective workpieces in the wire mesh cage are immersed in the degreasing solution. The cutting oil agent deposited on each workpiece is released.

The degreasing solution is a mixture of sodium hydroxide, sodium orthosilicate and a surface active agent in warm water. The temperature is from 50° C. to 60° C. The mixture ratio is as follows: 10 to 50 g/l of sodium hydroxide, 30 to 50 g/l of sodium orthosilicate, and 0.1 to 20 g/l of surface active agent. The time required for immersing the respective workpieces in the degreasing solution is from 10 minutes to 15 minutes.

After taken out of the degreasing solution in the processing tank, the wire mesh cage containing the workpieces is moved in water in a processing tank while sunk in the water in the "water washing step". Or the wire mesh cage suffers water jetted from a nozzle. The respective workpieces in the wire mesh cage are washed with flowing water. The degreasing solution containing the cutting oil agent deposited on each workpiece is washed off.

The workpieces go through the "oil agent removal step" and the "water washing step" successively, so that all the cutting oil agent deposited on surfaces of the workpieces is removed. The amount of the cutting oil agent remaining on the workpieces degreased and washed with water in this example was measured. The measuring device is the "oil count meter POC-100" made by Shimadzu Corporation. As a result of the measurement, the amount of the remaining oil agent is not larger than 0.2 mg per one workpiece having mass of from 40 g to 50 g. The amount of the remaining oil agent is substantially zero. All the cutting oil agent deposited and remaining on the workpieces in the "cutting step" is substantially removed by degreasing and water washing in the "oil agent removal step" and the "water washing step". Incidentally, the amount of the oil agent remaining on the workpieces degreased and washed with water is allowed if the amount is not a barrier to steps after that.

After going through the "water washing step", the wire mesh cage containing the workpieces reaches the "oil agent deposition step" without interposition of the drying step. In the "oil agent deposition step", the wire mesh cage containing the workpieces is moved in an oil agent solution in a processing tank while sunk in the oil agent solution. The respective workpieces in the wire mesh cage are immersed in the oil agent solution. The oil agent solution is deposited on the workpieces from which the cutting oil agent has been already removed.

The oil agent solution is prepared in such a manner that a water-soluble oil agent and an activator for dispersing the water-soluble oil agent are dissolved in water. The kind of the water-soluble oil agent to be contained in the oil agent solution is selected to be suitable for the "caulking step" which is the post-step. The kind of the activator to be contained in the oil agent solution is selected in accordance with the kind of the water-soluble oil agent to be contained in the oil agent solution. The concentrations of the water-soluble oil agent and the activator in the oil agent solution are adjusted in accordance with the amount of the oil agent suitable for the "caulking step" which is the post-step.

The oil agent solution is prepared in such a manner that the water-soluble oil agent and the activator are mixed and dissolved in warm water. The temperature is from 50° C. to 60° C. The water-soluble oil agent is provided as an aqueous solution containing about 30% of alkylamine oxide. The mixture ratio of the water-soluble oil agent is from 50 ml/l to 60 ml/l. The activator is a nonionic surface active agent. The mixture ratio of the activator is from 13 ml/l to 20 ml/l. The time required for immersing the workpieces in the oil agent solution is from a half minute to one minute.

After going out of the oil agent solution of the processing tank, the wire mesh cage containing the workpieces rotates in a centrifugal dryer in the "drying step". Or the wire mesh cage suffers hot air jetted from a nozzle in a hot air dryer. The respective workpieces in the wire mesh cage are dried centrifugally or dried with hot air. Centrifugal force blows off the water content from the oil agent solution deposited on the workpieces. Or the water content is vaporized. After the water content is removed, the oil content remains. An amount of the water-soluble oil agent corresponding to the concentration of the oil agent solution is deposited on each workpiece.

In this embodiment, the amount of the water-soluble oil agent deposited on each workpiece was measured. The measuring device is the aforementioned "oil count meter POC-100". As a result of the measurement, the amount of the water-soluble oil agent is from 4 mg to 30 mg per one workpiece having mass of from 40 g to 50 g. The amount of the deposited water-soluble oil agent is adjusted within a range of a target value ±10%.

The workpieces go through the "oil agent deposition step" and the "drying step" successively, so that the water-soluble oil agent is deposited on the workpieces. The kind and amount of the water-soluble oil agent are suitable for the "caulking step" after the "cutting step". The workpieces on which the water-soluble oil agent for caulking has been already deposited go through the "caulking step", so that the workpieces are caulked.

If the caulking water-soluble oil agent remaining on the caulked workpieces is a barrier after that, the water-soluble oil agent deposited on the caulked workpieces is heated to about 400° C. or higher. As a result, the water-soluble oil agent is decomposed, gasified and scattered. By heating the caulked workpieces, the remaining water-soluble oil agent can be removed easily.

Incidentally, to improve the rust-resisting effect of workpieces of stainless steel, a passivating step may be carried out between the aforementioned "water washing step" and the aforementioned "oil agent deposition step". In the passivating step, the degreased and water washed workpieces are immersed in an aqueous solution of nitric acid and washed with water in the same manner as in the aforementioned "water washing step" after the workpieces are taken out of the aqueous solution of nitric acid.

SECOND EXAMPLE

Figure 3:
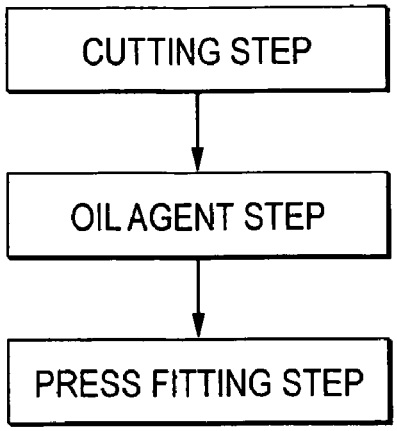
FIG. 3 A process view of a process, inclusive of a pre-step and a post-step, in the oil agent deposition method according to second and third examples of the embodiment.
Figure 4:
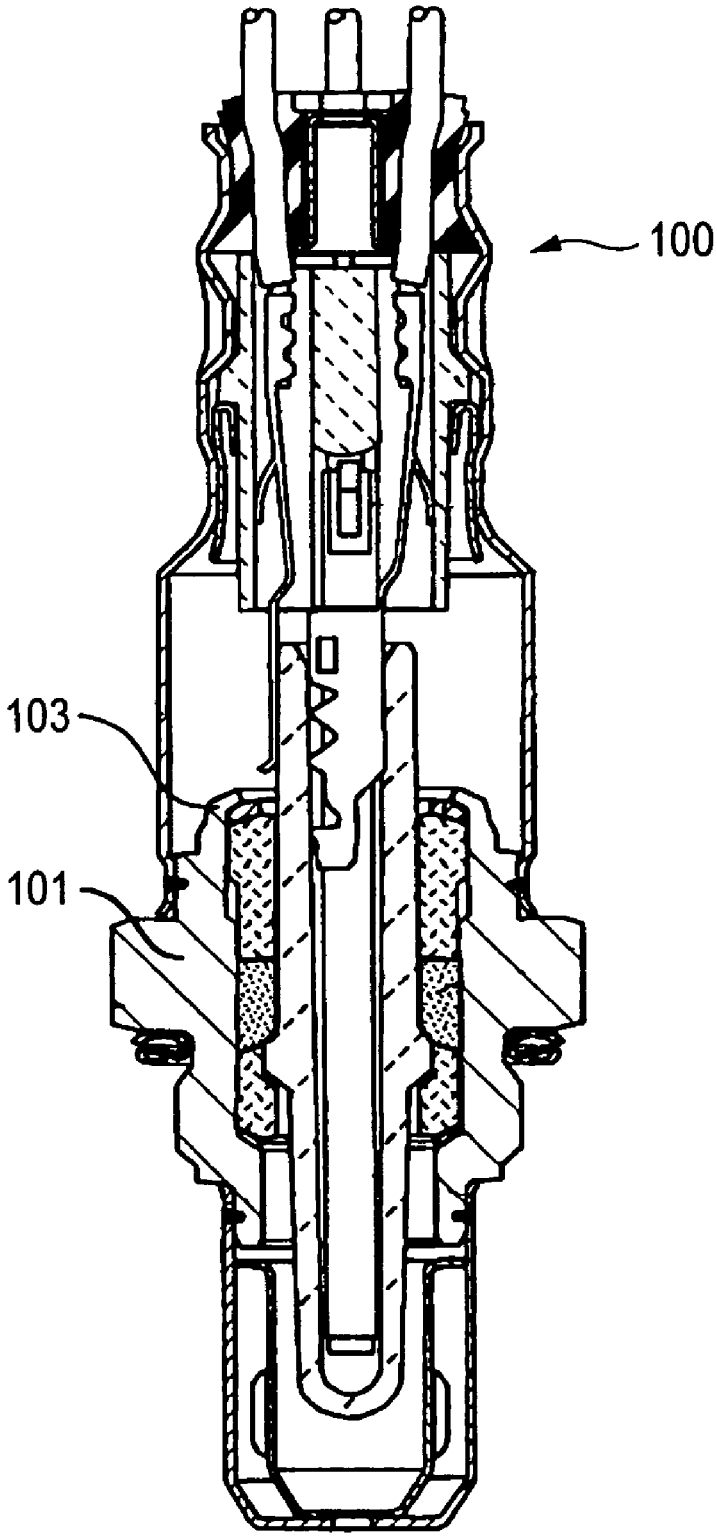
FIG. 4 An overall sectional view of a gas sensor having a metal shell on which an oil agent is deposited by use of the oil agent deposition method according to the present invention.
Figure 5:
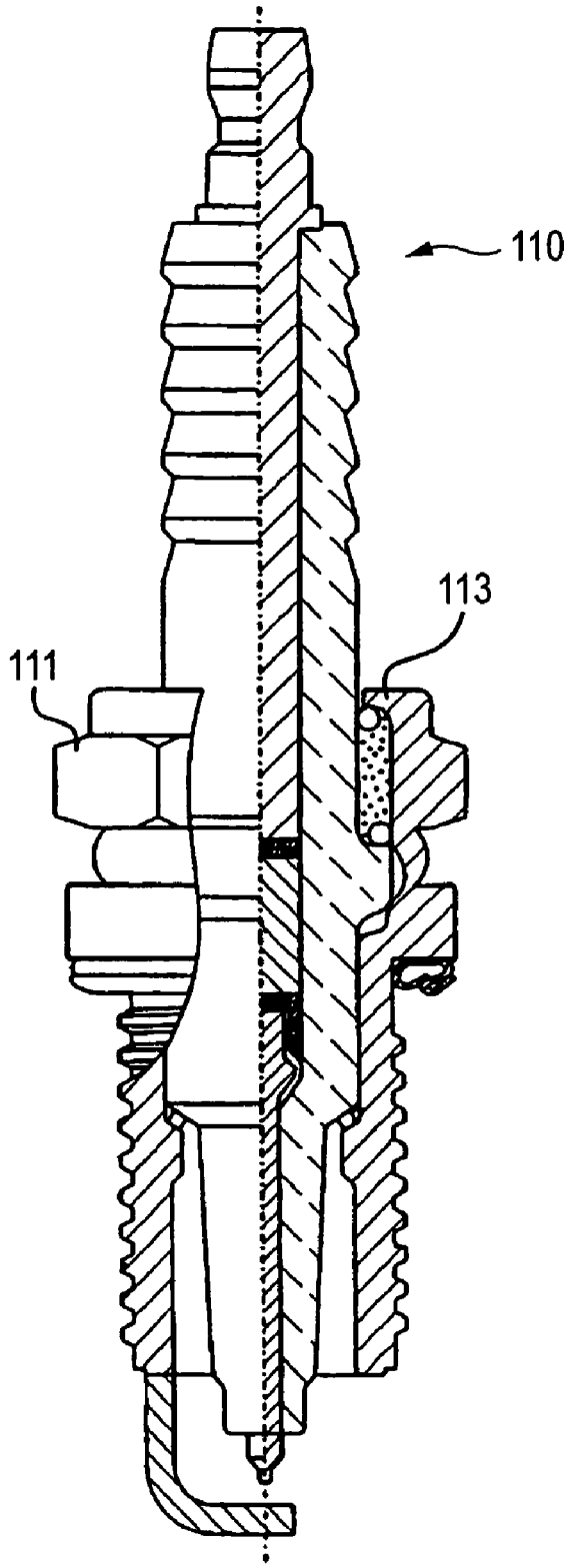
FIG. 5 A partly cutaway overall sectional view of a spark plug having a metal shell on which an oil agent is deposited by use of the oil agent deposition method according to the present invention.

See FIGS. 3 and 2

In this example, each workpiece is a metal component of a fluid machine and made of stainless steel. As shown in FIG. 3, the components go through a "cutting step", an "oil agent step" and a "press fitting step" successively. In the "oil agent step", the method of depositing an oil agent according to this example is carried out. The "press fitting step" is a kind of assembling.

The cutting oil agent used for cooling, lubrication and chip removal is deposited and remains on the workpieces cut by the "cutting step". The amount of the remaining deposited oil agent varies widely and is not suitable for the "press fitting step" after that. In the "press fitting step", a shaft portion of some workpiece is press-fitted into a hole portion of some workpiece. Accordingly, it is necessary to provide a lubricating oil agent for reducing friction at the time of press fitting.

Therefore, the workpieces cut by the "cutting step" which is the pre-step go through the "oil agent removal step", the "water washing step", the "oil agent deposition step" and the "drying step" successively as shown in FIG. 2 in place of the "oil agent step" before the "press fitting step" in order to deposit an oil agent of the amount and kind suitable for the "press fitting step" which is the post-step.

A large number of workpieces are put in a wire mesh cage. The workpieces are immersed in a degreasing solution in the "oil agent removal step" and washed with flowing water in the "water washing step". As a result, all the cutting oil agent is removed. The detail of the "oil agent removal step" and the "water washing step" is the same as in the first example.

After going through the "water washing step", the wire mesh cage containing the workpieces reaches the "oil agent deposition step" without interposition of the drying step. In the "oil agent deposition step", the wire mesh cage containing the workpieces is moved in an oil agent solution in a processing tank while sunk in the oil agent solution. The respective workpieces in the wire mesh cage are immersed in the oil agent solution. The oil agent solution is deposited on the workpieces from which the cutting oil agent has been already removed.

The oil agent solution is prepared in such a manner that a water-soluble oil agent is dissolved in water. The kind of the water-soluble oil agent to be contained in the oil agent solution is selected to be suitable for the "press fitting step" which is the post-step. The concentrations of the water-soluble oil agent in the oil agent solution are adjusted in accordance with the amount of the oil agent suitable for the "press fitting step" which is the post-step.

The oil agent solution is prepared in such a manner that a water-soluble oil agent is mixed and dissolved in warm water. The temperature is from 50° C. to 60° C. The water-soluble oil agent is a water-soluble polyalkylene glycol derivative which is generally used as lubricating oil or working oil. The mixture ratio of the water-soluble oil agent is from 10 ml/l to 50 ml/l. The time required for immersing the respective workpieces in the oil agent solution is from 0.5 to 1 minute.

After going out of the oil agent solution, the respective workpieces in the wire mesh cage are dried centrifugally or dried with hot air in the "drying step". After the water content is removed, the oil content remains. An amount of the water-soluble oil agent corresponding to the concentration of the oil agent solution is deposited on each workpiece.

The workpieces go through the "oil agent deposition step" and the "drying step" successively, so that the water-soluble oil agent is deposited on the workpieces. The kind and amount of the water-soluble oil agent are suitable for the "press fitting step" after the "cutting step". The workpieces on which the water-soluble oil agent for press fitting has been already deposited go through the "press fitting step", so that the workpieces are press-fitted.

THIRD EXAMPLE

See FIGS. 3 and 2

In this example, each workpiece is a metal component of an internal combustion engine and made of an aluminum alloy. As shown in FIG. 3, the components go through the "cutting step", the "oil agent step" and the "press fitting step" successively in the same manner as in the second example. In the "oil agent step", the method of depositing an oil agent according to this embodiment is carried out.

The workpieces cut by the "cutting step" which is the pre-step go through the "oil agent removal step", the "water washing step", the "oil agent deposition step" and the "drying step" successively as shown in FIG. 2 in the same manner as in the second example in place of the "oil agent step" before the "press fitting step" in order to deposit an oil agent suitable for the "press fitting step" which is the post-step.

A large number of workpieces are put in a wire mesh cage. The workpieces are immersed in a degreasing solution in the "oil agent removal step" and washed with flowing water in the "water washing step". All the cutting oil agent is removed.

The degreasing solution is a mixture of sodium bicarbonate, sodium tertiary phosphate and a surface active agent in warm water. The temperature is from 50° C. to 60° C. The mixture ratio is as follows: 1 to 10 g/l of sodium bicarbonate, 10 to 30 g/l of sodium tertiary phosphate, and 0.1 to 20 g/l of surface active agent. The time required for immersing the workpieces in the degreasing solution is from 10 minutes to 15 minutes. The "water washing step" is the same as in the first example.

After going through the "water washing step", the wire mesh cage containing the workpieces reaches the "oil agent deposition step" without interposition of the drying step. In the "oil agent deposition step", the wire mesh cage containing the workpieces is moved in an oil agent solution in a processing tank while sunk in the oil agent solution. The respective workpieces in the wire mesh cage are immersed in the oil agent solution. The oil agent solution is deposited on the workpieces from which the cutting oil agent has been already removed.

The oil agent solution is prepared in such a manner that a water-soluble oil agent and an activator for dispersing the water-soluble oil agent are dissolved in water. The kind of the water-soluble oil agent to be contained in the oil agent solution is selected to be suitable for the "press fitting step" which is the post-step. The kind of the activator to be contained in the oil agent solution is selected in accordance with the kind of the water-soluble oil agent to be contained in the oil agent solution. The concentrations of the water-soluble oil agent and the activator in the oil agent solution are adjusted in accordance with the amount of the oil agent suitable for the "press fitting step" which is the post-step.

The oil agent solution is prepared in such a manner that the water-soluble oil agent and the activator are mixed and dissolved in warm water. The temperature is from 50° C. to 60° C. The water-soluble oil agent is provided as an aqueous solution containing about 30% of alkylamine oxide. The mixture ratio of the water-soluble oil agent is from 50 ml/l to 60 ml/l. The activator is a nonionic surface active agent. The mixture ratio of the activator is from 13 ml/l to 20 ml/l. The time required for immersing the workpieces in the oil agent solution is from a half minute to one minute.

After going out of the oil agent solution, the respective workpieces in the wire mesh cage go through the "drying step" in the same manner as in the first example so that the workpieces are dried. An amount of the water-soluble oil agent corresponding to the concentration of the oil agent solution is deposited on each workpiece. The kind and amount of the water-soluble oil agent are suitable for the "press fitting step" after the "cutting step". The workpieces on which the water-soluble oil agent for press fitting has been already deposited go through the "press fitting step", so that the workpieces are press-fitted.

If the press-fitting water-soluble oil agent remaining on the press-fitted workpieces is a barrier after that, the water-soluble oil agent is heated to be vaporized.

Although the present invention has been described in detail and with reference to specific embodiments, it is obvious to those skilled in the art that various changes and modifications may be made without departing from the spirit and scope of the present invention.

This application is based on Japanese Patent Application (Patent Application 2004-003409) filed on Jan. 8, 2004 and the contents thereof are incorporated by reference.

INDUSTRIAL APPLICABILITY

The present invention can be used for processing metal components such as oxygen sensor fittings or ignition plug fittings in an internal combustion engine, synthetic resin or ceramic components and products, and in-process products thereof.

The invention claimed is:

1. A method for depositing an oil agent on a workpiece, comprising:

a removal step of immersing a workpiece having a remaining oil agent in a degreasing solution, taking the workpiece out of the degreasing solution and cleaning the workpiece by water washing so as to remove all the oil agent deposited on the workpiece;

an oil agent deposition step of immersing the workpiece wet with water after the water washing in an oil agent solution containing a water-soluble oil agent dissolved in water, taking the workpiece out of the oil agent solution and drying the workpiece so as to deposit a predetermined amount of the water-soluble oil agent on the workpiece; and a caulking step of caulking the workpiece having deposited thereon a predetermined amount of the water-soluble oil agent and a step of heating the caulked workpiece to a temperature of 400° C. or higher to thereby decompose and gasify the water-soluble oil agent that had been deposited on the workpiece.

2. The method for depositing an oil agent on a workpiece according to claim 1, wherein a concentration of the oil agent solution is adjusted so that the amount of the water-soluble oil agent deposited on the workpiece is set to be a predetermined amount suitable for a post-step.

3. The method for depositing an oil agent on a workpiece according to claim 1, wherein a kind of the water-soluble oil agent put into the oil agent solution is selected so that the kind of the water-soluble oil agent deposited on the workpiece is set to be a kind suitable for a post-step.

4. The method for depositing an oil agent on a workpiece according to claim 1, wherein the workpiece is a metal component to be attached to an internal combustion engine.

5. The method for depositing an oil agent on a workpiece according to claim 1, wherein the water-soluble oil agent is selected from the group consisting of an emulsion prepared by emulsifying mineral oil with an anionic surface active agent, a chemical solution of a water-soluble oil agent containing an inorganic salt as a main component and a solution of a water-soluble oil agent containing a surface active agent as a main component.

* * * * *